US012000073B2

(12) United States Patent
Kellow et al.

(10) Patent No.: US 12,000,073 B2
(45) Date of Patent: Jun. 4, 2024

(54) ADJUSTED OPERATION OF A COMBINATION WASHER/DRYER APPLIANCE

(71) Applicant: Haier US Appliance Solutions, Inc., Wilmington, DE (US)

(72) Inventors: Jeffrey Kellow, Louisville, KY (US); David Scott Dunn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 525 days.

(21) Appl. No.: 17/245,739

(22) Filed: Apr. 30, 2021

(65) Prior Publication Data

US 2022/0349105 A1 Nov. 3, 2022

(51) Int. Cl.

| | |
|---|---|
| ***D06F 33/60*** | (2020.01) |
| ***D06F 33/56*** | (2020.01) |
| ***D06F 34/28*** | (2020.01) |
| ***D06F 101/20*** | (2020.01) |
| ***D06F 103/40*** | (2020.01) |
| ***D06F 105/28*** | (2020.01) |
| ***D06F 105/62*** | (2020.01) |

(52) U.S. Cl.

CPC ..... *D06F 33/60* (2020.02); *D06F 33/56* (2020.02); *D06F 34/28* (2020.02); *D06F 2101/20* (2020.02); *D06F 2103/40* (2020.02); *D06F 2105/28* (2020.02); *D06F 2105/62* (2020.02)

(58) Field of Classification Search

CPC ..... D06F 33/60; D06F 33/56; D06F 34/28; D06F 2105/62; D06F 2105/28; D06F 2103/40; D06F 2101/20

USPC ..... 34/524, 595–610

See application file for complete search history.

(56) References Cited

U.S. PATENT DOCUMENTS 7,424,809 B2 9/2008 Son
7,647,794 B2 * 1/2010 Park ..... D06F 39/008 68/12.22

(Continued)

FOREIGN PATENT DOCUMENTS

CA 2661211 A1 * 2/2008 ..... D06F 29/00
JP 2003053087 A 2/2003

(Continued)

*Primary Examiner* — Stephen M Gravini

(74) *Attorney, Agent, or Firm* — Dority & Manning, P.A.

(57) ABSTRACT

A combination washer/dryer appliance may include a cabinet, a tub, a laundry basket, a heater, and a controller. The laundry basket may be rotatably mounted within the tub and define a chamber for receipt of articles for washing or drying. The controller may be operably coupled to the heater and configured to initiate a wash/dry operation. The wash/dry operation may include initiating a wash/dry operation for articles within the laundry basket. The wash/dry operation may include a wash cycle and a dry cycle. The wash/dry operation may further include determining completion of the wash cycle and directing a tumble cycle of the laundry basket in response to determining completion of the wash cycle. The wash/dry operation may still further include determining a user drying preference during the tumble cycle of the laundry basket and adjusting the wash/dry operation based on the determined user drying preference.

20 Claims, 4 Drawing Sheets

(56) References Cited

U.S. PATENT DOCUMENTS

| | | | | |
|---|---|---|---|---|
| 8,984,913 | B2 * | 3/2015 | Park | D06F 34/28 68/3 R |
| 9,745,682 | B2 * | 8/2017 | Park | D06F 29/00 |
| 9,837,820 | B2 * | 12/2017 | Santinato | H02J 3/008 |
| 10,963,979 | B1 * | 3/2021 | Breitman | H04L 67/125 |
| 11,203,829 | B2 * | 12/2021 | Lee | D06F 34/18 |
| 11,379,756 | B2 * | 7/2022 | Han | D06F 33/00 |
| 2022/0349105 | A1 * | 11/2022 | Kellow | D06F 33/68 |
| 2023/0195146 | A1 * | 6/2023 | Zheng | D06F 25/00 62/159 |
| 2023/0366139 | A1 * | 11/2023 | Yoon | D06F 33/69 |
| 2023/0392316 | A1 * | 12/2023 | Rodriguez Munoz | D06F 34/05 |

FOREIGN PATENT DOCUMENTS

| | | | | |
|---|---|---|---|---|
| JP | 6620179 | B2 | 12/2019 | |
| WO | WO-2008023909 | A2 * | 2/2008 | D06F 29/00 |
| WO | WO-2008077838 | A1 * | 7/2008 | D06F 58/02 |
| WO | WO2014176918 | A1 | 11/2014 | |
| WO | WO2016095511 | A1 | 6/2016 | |

* cited by examiner

ADJUSTED OPERATION OF A COMBINATION WASHER/DRYER APPLIANCE

FIELD OF THE INVENTION

The present subject matter relates generally to combined washer/dryer appliances and methods for operating the same.

BACKGROUND OF THE INVENTION

Over the past several decades, many advancements have been made in the field of washing and drying appliances. Generally, such appliances have greatly increased the ease and convenience for cleaning clothing articles. In spite of the advancements, though, difficulties still exist with transitioning from a wash cycle in which the articles are actually cleaned to a drying operation or cycle in which the articles are dried. It is not uncommon for a user to start a wash cycle on a washing machine appliance only to forget to remove or dry the articles within the washing machine appliance after the wash cycle is complete, allowing wet articles to remain static within the appliance. This may cause wrinkles, mildew, or unpleasant smells to form on the articles. Modern combination washer/dryer appliances have the ability to directly transition from a wash cycle to a dry cycle without requiring a user to interact with the appliance in between those cycles.

Nonetheless, difficulties still exist. For instance, some loads (e.g., discrete collections of articles to be washed or dried together) may include one or more delicate articles or articles that a user wishes to remove following a wash cycle and prior to a dry cycle. In particular, a user may wish to air dry only certain articles from a load. Additionally or alternatively, a user may need to evaluate whether a stain on one or more articles has been removed. This may be especially important in order to ensure certain articles are not exposed to the active heat of a dry cycle (e.g., to avoid "baking in" a stain). Although a user may try to closely monitor the progress of a washing or combined wash/dry operation, this can be especially cumbersome, difficult, or otherwise unacceptable to users.

As a result, further improvements would be desirable to provide appliances or methods to address one or more of the above issues. In particular, appliances or methods for permitting the selective removal of articles prior to being heated (e.g., while preventing the formation of wrinkles, mildew, or foul smells) would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a combination washer/dryer appliance is provided. The combination washer/dryer appliance may include a cabinet, a tub, a laundry basket, a heater, and a controller. The tub may be positioned within the cabinet. The tub may define a tub outlet and a tub inlet. The laundry basket may be rotatably mounted within the tub. The laundry basket may define a chamber for receipt of articles for washing or drying. The heater may be configured to heat and remove moisture from air flowing therethrough. The controller may be operably coupled to the heater and configured to initiate a wash/dry operation. The wash/dry operation may include initiating a wash/dry operation for articles within the laundry basket. The wash/dry operation may include a wash cycle and a dry cycle. The wash/dry operation may further include determining completion of the wash cycle and directing a tumble cycle of the laundry basket in response to determining completion of the wash cycle. The tumble cycle may include rotating the laundry basket. The wash/dry operation may still further include determining a user drying preference during the tumble cycle of the laundry basket and adjusting the wash/dry operation based on the determined user drying preference.

In another exemplary aspect of the present disclosure, a method of operating a combination washer/dryer appliance is provided. The method may include initiating a wash/dry operation for articles within a laundry basket. The wash/dry operation may include a wash cycle and a dry cycle. The method may further include determining completion of the wash cycle and directing a tumble cycle of the laundry basket in response to determining completion of the wash cycle. The tumble cycle may include rotating the laundry basket. The method may still further include determining a user drying preference during the tumble cycle of the laundry basket and adjusting the wash/dry operation based on the determined user drying preference.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
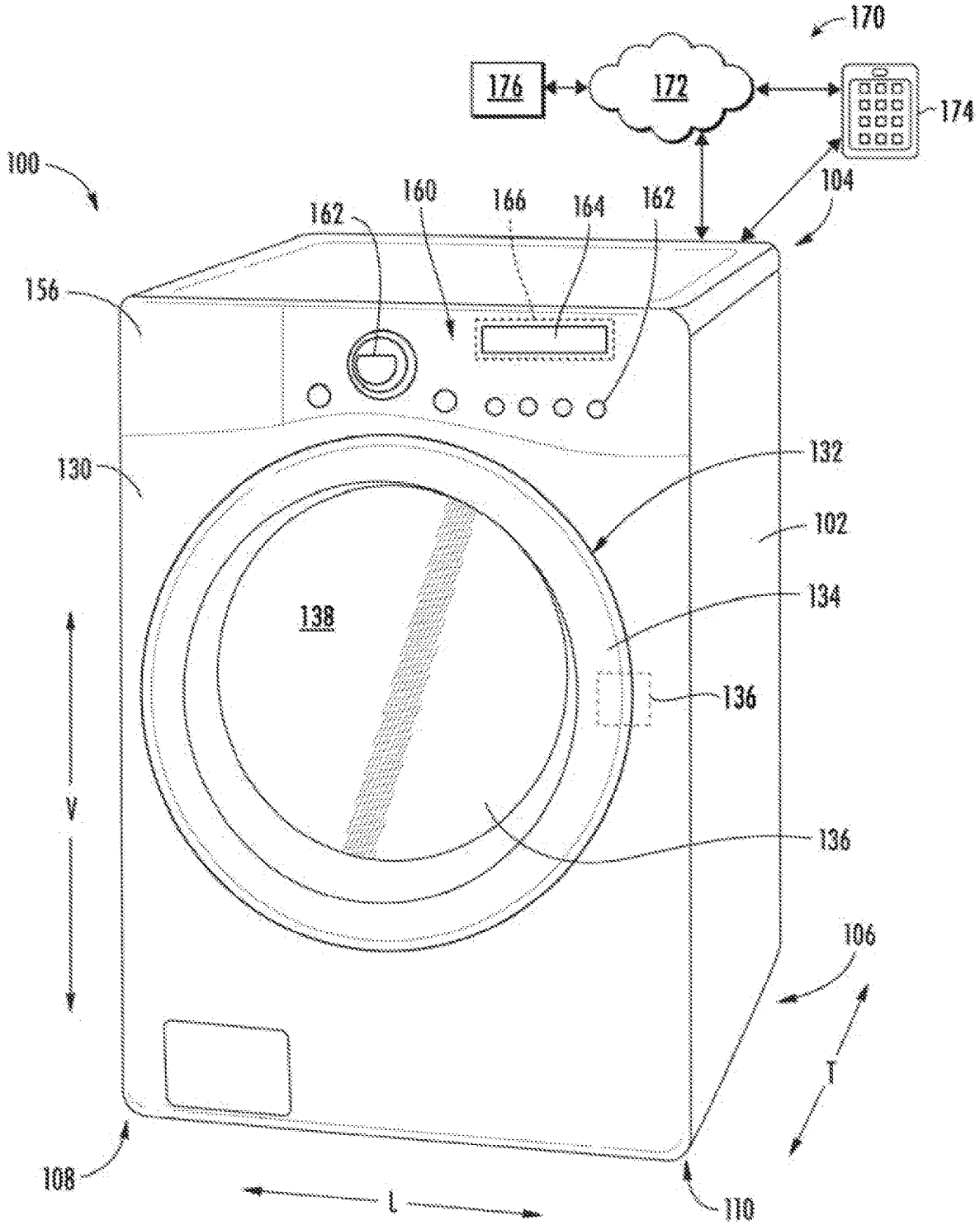
FIG. 1 provides a perspective view of a laundry appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
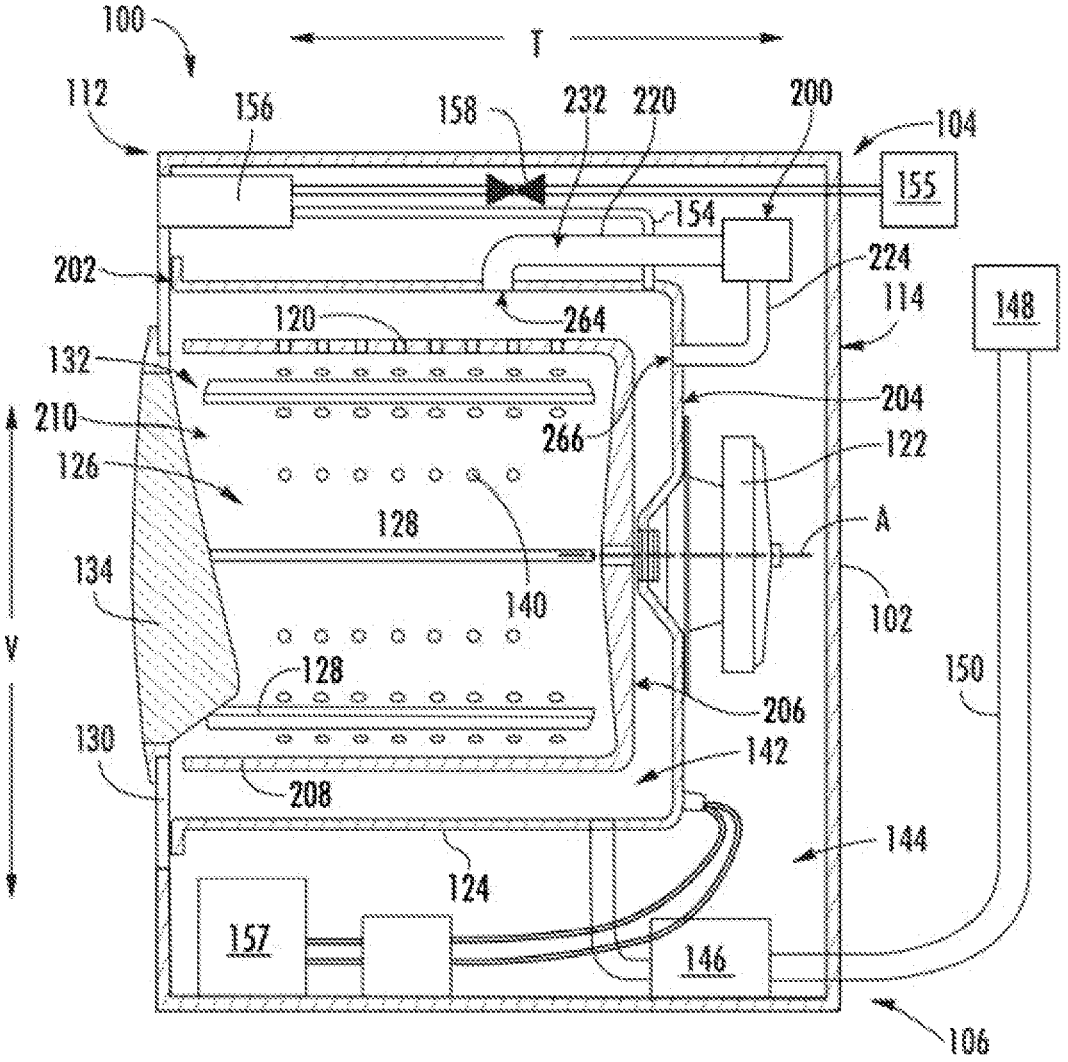
FIG. 2 provides a side sectional view of the exemplary laundry appliance of FIG. 1.

Referring now to the figures, an exemplary laundry appliance that may be used to implement aspects of the present subject matter will be described. Specifically, FIG. 1 is a perspective view of an exemplary horizontal axis washer/dryer appliance 100 (e.g., washer and condenser dryer combination appliance), referred to herein for simplicity as laundry appliance 100. FIG. 2 is a side sectional view of laundry appliance 100. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a laundry basket 120 is rotatably mounted within cabinet 102 such that it is rotatable about an axis of rotation A. According to the illustrated embodiment, axis of rotation A is substantially parallel to a horizontal direction (e.g., the transverse direction T), as this exemplary appliance is a front load appliance. A motor 122, such as a pancake motor, is in mechanical communication with laundry basket 120 to selectively rotate laundry basket 120 (e.g., during an agitation or a rinse phase of laundry appliance 100). Motor 122 may be mechanically coupled to laundry basket 120 directly or indirectly (e.g., via a pulley and a belt—not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together or dried together in laundry appliance 100 (e.g., the combination washer and condenser dryer) and may include a mixture of different or similar articles of clothing of different or similar types and kinds of fabrics, textiles, garments and linens within a particular laundering process.

The tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIG. 2, a plurality of baffles or ribs 128 extend from basket 120 into chamber 126. In this manner, for example, ribs 128 may lift articles disposed in laundry basket 120 and then allow such articles to tumble back to a bottom of drum laundry basket 120 as it rotates. Ribs 128 may be mounted to laundry basket 120 such that ribs 128 rotate with laundry basket 120 during operation of laundry appliance 100.

Referring generally to FIGS. 1 and 2, cabinet 102 may include a front panel 130 which defines an opening 132 that permits user access to laundry basket 120 and tub 124. More specifically, laundry appliance 100 includes a door 134 that is positioned over opening 132 and is rotatably mounted to front panel 130. In this manner, door 134 permits selective access to opening 132 by being movable between an open position (not shown) facilitating access to a tub 124 and a closed position (FIG. 1) prohibiting access to tub 124. Laundry appliance 100 may further a latch assembly 136 (see FIG. 1) that is mounted to cabinet 102 or door 134 for selectively locking door 134 in the closed position or detecting the door 134 in the closed position. Latch assembly 136 may be desirable, for example, to ensure only secured access to chamber 126 or to otherwise ensure and verify that door 134 is closed during certain operating cycles or events.

In some embodiments, a window 138 in door 134 permits viewing of laundry basket 120 when door 134 is in the closed position (e.g., during operation of laundry appliance 100). Door 134 may include a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, laundry basket 120 may also define a plurality of perforations 140 in order to facilitate fluid communication between an interior of basket 120 and tub 124. A sump 142 is defined by tub 124 at a bottom of tub 124 along the vertical direction V. Thus, sump 142 is configured for receipt of and generally collects wash fluid during operation of laundry appliance 100. For example, during operation of laundry appliance 100, wash fluid may be urged by gravity from basket 120 to sump 142 through plurality of perforations 140.

In some embodiments, a drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with an external drain 148 through a drain hose 150. During a drain cycle or phase (e.g., as a portion of a wash cycle), drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into tub 124. For example, spout 154 may be in fluid communication with a water supply 155 (FIG. 2) in order to direct fluid (e.g., clean water or wash fluid) into tub 124. Spout 154 may also be in fluid communication with the sump 142. For example, pump assembly 144 may direct wash fluid disposed in sump 142 to spout 154 in order to circulate wash fluid in tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

A water supply valve or control valve 158 may provide a flow of water from a water supply source (such as a municipal water supply 155) into detergent dispenser 156 or into tub 124. In this manner, control valve 158 may generally be operable to supply water into detergent dispenser 156 to generate a wash fluid (e.g., for use in a wash cycle) or a flow of fresh water (e.g., for a rinse phase). It should be appreciated that control valve 158 may be positioned at any other suitable location within cabinet 102.

A control panel 160 including a plurality of input selectors 162 (e.g., buttons, knobs, toggles, touch screens, etc.) is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of laundry appliance 100 is controlled by a controller or processing device 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry—such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into laundry basket 120 through opening 132, and a washing or wash/dry operation (e.g., having discrete wash and dry cycles) is initiated through operator manipulation of input selectors 162. Tub 124 is filled with water, detergent, or other fluid additives (e.g., via spout 154 and or detergent drawer 156). One or more valves (e.g., control valve 158) can be controlled by laundry appliance 100 to provide for filling laundry basket 120 to the appropriate level for the amount of articles being washed or rinsed. By way of example for a wash cycle, once laundry basket 120 is properly filled with fluid, the contents of laundry basket 120 can be agitated (e.g., with ribs 128) for washing of articles in laundry basket 120.

After an agitation phase of the wash cycle is completed, tub 124 can be drained. Laundry articles can then be rinsed by again adding fluid to tub 124, depending on the particulars of the cleaning cycle selected by a user. Ribs 128 may again provide agitation within laundry basket 120. One or more spin cycles or phases may also be used. In particular, a spin phase may be applied after the wash cycle or after the rinse phase in order to wring wash fluid from the articles being washed. During a final spin cycle, basket 120 is rotated at relatively high speeds and drain pump assembly 144 may discharge wash fluid from sump 142. Following the wash cycle, a dry cycle may be executed or operation a user may selectively remove the articles from laundry basket 120 (e.g., by opening door 134 and reaching into laundry basket 120 through opening 132), as will be described in greater detail below.

While described in the context of a specific embodiment of horizontal axis laundry appliance 100, using the teachings disclosed herein it will be understood that horizontal axis laundry appliance 100 is provided by way of example only. Other laundry appliances having different configurations, different appearances, or different features may also be utilized with the present subject matter as well (e.g., vertical axis laundry appliances). Indeed, it should be appreciated that aspects of the present subject matter may further apply to other laundry appliances. In this regard, the same methods as systems and methods as described herein may be used to implement travel cycles for other appliances, as described in more detail below.

Referring still to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100.

External communication system 170 permits controller 166 of laundry appliance 100 to communicate with external devices either directly or through a network 172. For example, a consumer may use a consumer device 174 to communicate directly with laundry appliance 100. For example, consumer devices 174 may be in direct or indirect communication with laundry appliance 100, such directly through a local area network (LAN), Wi-Fi, Bluetooth, Zigbee, etc. or indirectly through network 172. In general, consumer device 174 may include its own user interface and be any suitable device for providing or receiving communications or commands from a user. In this regard, consumer device 174 may include, for example, a personal phone, a tablet, a laptop computer, or another mobile device.

In addition, a remote server 176 may be in communication with laundry appliance 100 or consumer device 174 through network 172. In this regard, for example, remote server 176 may be a cloud-based server 176, and is thus located at a distant location, such as in a separate state, country, etc. In general, communication between the remote server 176 and the client devices may be carried via a network interface using any type of wireless connection, using a variety of communication protocols (e.g. TCP/IP, HTTP, SMTP, FTP), encodings or formats (e.g. HTML, XML), or protection schemes (e.g. VPN, secure HTTP, SSL).

In general, network 172 can be any type of communication network. For example, network 172 can include one or more of a wireless network, a wired network, a personal area network, a local area network, a wide area network, the internet, a cellular network, etc. According to an exemplary embodiment, consumer device 174 may communicate with a remote server 176 over network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 3:
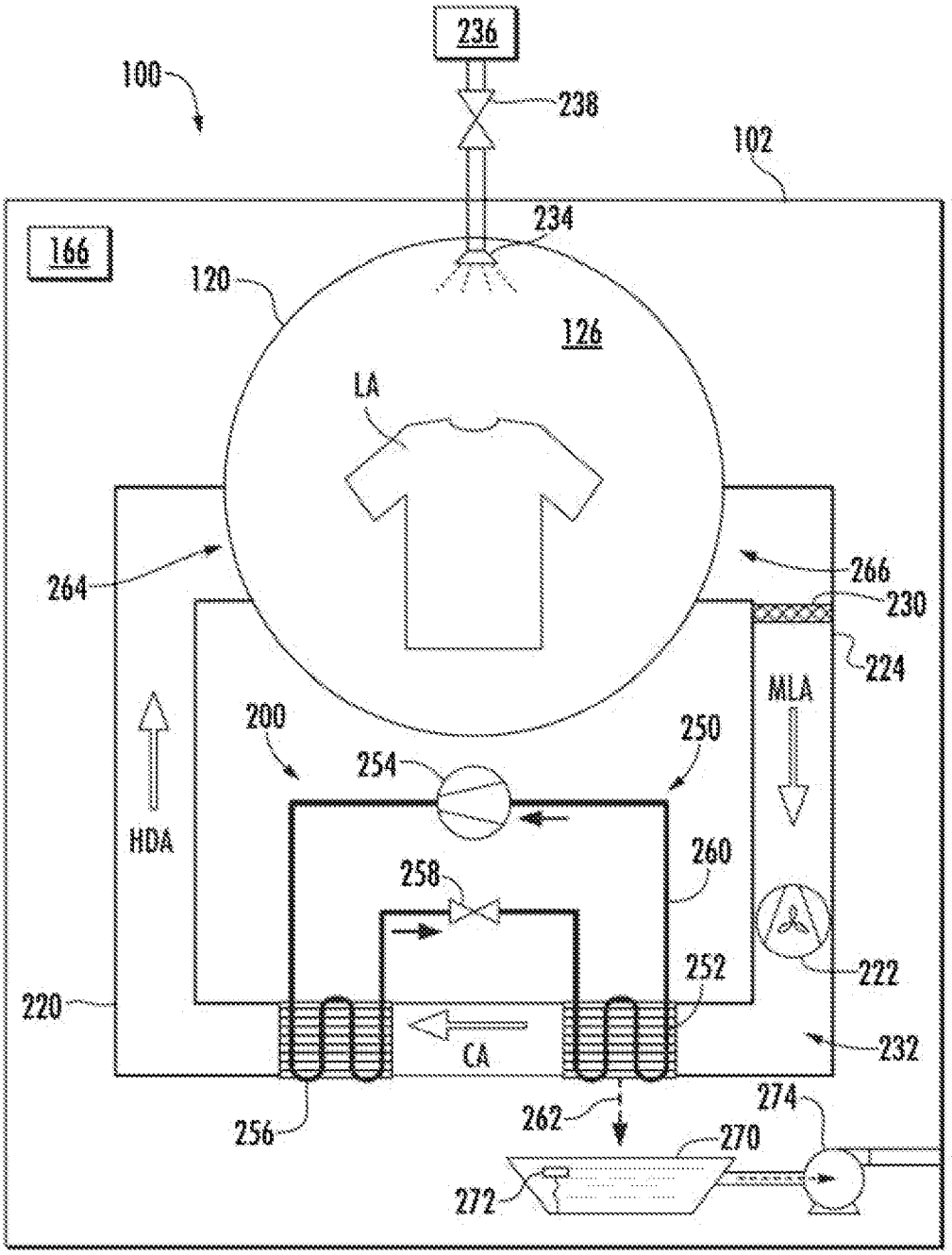
FIG. 3 provides a schematic diagram of an exemplary heat pump dryer appliance and a conditioning system thereof in accordance with exemplary embodiments of the present disclosure.

Referring now specifically to FIGS. 2 and 3, a heater included with or provided as a heat pump system, a condenser system, a refrigerant-based air conditioning system, or another suitable conditioning system 200 for facilitating a drying process or dry cycle within laundry appliance 100 will be described in more detail. As illustrated, conditioning system 200 may be mounted to tub 124 such that it is fluidly coupled to chamber 126. More specifically, as illustrated, tub 124 extends between a front portion 202 and a back portion 204 (e.g., along the transverse direction T). Laundry basket 120 also includes a back or rear wall 206 (e.g., at back portion of laundry basket 120 or proximate back portion 204 of tub 124). Rear wall 206 of laundry basket 120 may be rotatably supported within cabinet 102 by a suitable bearing or may be fixed or rotatable.

In some embodiments, laundry basket 120 is generally cylindrical in shape. For instance, laundry basket 120 may have an outer cylindrical wall 208 and a front flange or wall that defines an opening 210 of laundry basket 120 (e.g., at front portion 202 of laundry basket 120). As shown, opening 210 generally coincides with opening 132 of front panel 112 of cabinet 102 (e.g., to provide user access to chamber 126 for loading and unloading of articles into and out of chamber 126 of laundry basket 120).

Conditioning system 200 may include a return duct 220 that is mounted to tub 124 for circulating air within chamber 126 to facilitate a dry cycle. For example, according to the illustrated exemplary embodiments, return duct 220 is fluid coupled to tub 124 proximate a top of tub 124. Return duct 220 receives heated air that has been heated or dehumidified by a conditioning system 200 and provides the heated air to laundry basket 120 via one or more holes defined by rear wall 206 or cylindrical wall 208 of laundry basket 120 (e.g., such as perforations 140).

Specifically, moisture laden, heated air is drawn from laundry basket 120 by an air handler, such as a blower fan 222, which may generate a negative air pressure within laundry basket 120. As the air passes from blower fan 222, it enters an intake duct 224 and then is passed into conditioning system 200. In some embodiments, the conditioning system 200 may have a heater that includes or is provided as an electric heating element (e.g., a resistive heating element) or a gas-powered heating element (e.g., a gas burner), as would be understood. According to the illustrated exemplary embodiment, laundry appliance 100 is a heat pump dryer appliance and thus conditioning system 200 may be or include a heater including a heat pump having a sealed refrigerant circuit, as described in more detail below with reference to FIG. 3. Heated air (with a lower moisture content than was received from laundry basket 120), exits conditioning system 200 and returns to laundry basket 120 by a return duct 220. After the clothing articles have been dried, they may be removed from the laundry basket 120 via opening 132.

As shown, laundry appliance 100 may further include one or more lint filters 230 (FIG. 3) to collect lint during drying operations. The moisture laden heated air passes through intake duct 224 enclosing screen filter 230, which traps lint particles. More specifically, filter 230 may be placed into an air flow path 232 defined by laundry basket 120, conditioning system 200, intake duct 224, and return duct 220. Filter 230 may be positioned in the process air flow path 232 and may include a screen, mesh, other material to capture lint in the air flow 232. The location of lint filters in laundry appliance 100 as shown in FIG. 3 is provided by way of example only, and other locations may be used as well. According to exemplary embodiments, lint filter 230 is readily accessible by a user of the appliance. As such, lint filter 230 should be manually cleaned by removal of the filter, pulling or wiping away accumulated lint, and then replacing the filter 230 for subsequent drying or dry cycles.

According to optional embodiments, laundry appliance 100 may facilitate a steam dry process. In this regard, laundry appliance 100 may offer a steam dry cycle, during which steam is injected into chamber 126 (e.g., to function similar to a traditional garment steamer to help remove wrinkles, static, etc.). Accordingly, as shown for example in FIG. 3, laundry appliance 100 may include a misting nozzle 234 that is in fluid communication with a water supply 236 (e.g., such as water supply 155) in order to direct mist into chamber 126. Laundry appliance 100 may further include a water supply valve or control valve 238 for selecting discharging the flow of mist into chamber 126. It should be appreciated that control valve 238 may be positioned at any other suitable location within cabinet 102.

FIG. 3 provides a schematic view of laundry appliance 100 and depicts conditioning system 200 in more detail. In the illustrated embodiments, laundry appliance 100 is a heat pump dryer appliance and thus conditioning system 200 includes a sealed system 250. Sealed system 250 includes various operational components, which can be encased or located within a machinery compartment of laundry appliance 100. Generally, the operational components are operable to execute a vapor compression cycle for heating process air passing through conditioning system 200. The operational components of sealed system 250 include an evaporator 252, a compressor 254, a condenser 256, and one or more expansion devices 258 connected in series along a refrigerant circuit or line 260. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components (e.g., at least one additional evaporator, compressor, expansion device, or condenser). For instance, sealed system 250 may include two evaporators.

In performing a dry cycle, one or more laundry articles LA may be placed within the chamber 126 of laundry basket 120. For instance, following a wash cycle, articles may remain within the chamber 126. Hot dry air HDA may be supplied to chamber 126 via return duct 220. The hot dry air HDA enters chamber 126 of laundry basket 120 via a tub inlet 264 defined by laundry basket 120 (e.g., the plurality of holes defined in rear wall 206 or cylindrical wall 208 of laundry basket 120 as shown in FIG. 2). The hot dry air HDA provided to chamber 126 causes moisture within laundry articles LA to evaporate. Accordingly, the air within chamber 126 increases in water content and exits chamber 126 as warm moisture laden air MLA. The warm moisture laden air MLA exits chamber 126 through a tub outlet 266 defined by laundry basket 120 and flows into intake duct 224.

After exiting chamber 126 of laundry basket 120, the warm moisture laden air MLA flows downstream to conditioning system 200. Blower fan 222 moves the warm moisture laden air MLA, as well as the air more generally, through a process air flow path 232 defined by laundry basket 120, conditioning system 200, intake duct 224, and return duct 220. Thus, generally, blower fan 222 is operable to move air through or along the process air flow path 232. The duct system includes all ducts that provide fluid communication (e.g., airflow communication) between tub outlet 266 and conditioning system 200 and between conditioning system 200 and tub inlet 264. Although blower fan 222 is shown positioned between laundry basket 120 and conditioning system 200 along intake duct 224, it will be appreciated that blower fan 222 can be positioned in other suitable positions or locations along the duct system.

As further depicted in FIG. 3, the warm moisture laden air MLA flows into or across evaporator 252 of the conditioning system 200. As the moisture-laden air MLA passes across evaporator 252, the temperature of the air is reduced through heat exchange with refrigerant that is vaporized within, for example, coils or tubing of evaporator 252. This vaporization process absorbs both the sensible and the latent heat from the moisture-laden air MLA—thereby reducing its temperature. As a result, moisture in the air is condensed and such condensate water may be drained from conditioning system 200 (e.g., using a drain line 262, which is also depicted in FIG. 3).

In optional embodiments, a condenser tank or a condensate collection tank 270 is in fluid communication with conditioning system 200 (e.g., via drain line 262). Collection tank 270 is operable to receive condensate water from the process air flowing through conditioning system 200, and more particularly, condensate water from evaporator 252. A sensor 272 operable to detect when water within collection tank 270 has reached a predetermined level. Sensor 272 can be any suitable type of sensor, such as a float switch as shown in FIG. 3. Sensor 272 can be communicatively coupled with controller 166 (e.g., via a suitable wired or wireless communication link). A drain pump 274 is in fluid communication with collection tank 270. Drain pump 274 is operable to remove a volume of water from collection tank 270 and, for example, discharge the collected condensate to an external drain. In some embodiments, drain pump 274 can remove a known or predetermined volume of water from collection tank 270. Drain pump 274 can remove the condensate water from collection tank 270 and can move or drain the condensate water downstream (e.g., to a gray water collection system). Particularly, in some embodiments, controller 166 is configured to receive, from sensor 272, an input indicating that water within the collection tank has reached the predetermined level. In response to the input indicating that water within collection tank 270 has reached the predetermined level, controller 166 can cause drain pump 274 to remove the predetermined volume of water from collection tank 270.

Air passing over evaporator 252 becomes cooler than when it exited laundry basket 120 at tub outlet 266. As shown in FIG. 3, cool air CA (cool relative to hot dry air HDA and moisture laden air MLA) flowing downstream of evaporator 252 is subsequently caused to flow across condenser 256 (e.g., across coils or tubing thereof), which condenses refrigerant therein. The refrigerant enters condenser 256 in a gaseous state at a relatively high temperature compared to the cool air CA from evaporator 252. As a result, heat energy is transferred to the cool air CA at the condenser 256, thereby elevating its temperature and providing warm dry air HDA for resupply to laundry basket 120 of laundry appliance 100. The warm dry air HDA passes over and around laundry articles LA within the chamber 126 of the laundry basket 120, such that warm moisture laden air MLA is generated, as mentioned above.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool air CA from evaporator 252 flows across condenser 256, the refrigerant is cooled and its temperature is lowered as heat is transferred to the air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. Importantly, the flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden air MLA received from chamber 126 of laundry basket 120. The process is repeated as air is circulated along process air flow path 232 while the refrigerant is cycled through sealed system 250, as described above.

In the case of a tumble cycle, the heater (e.g., sealed system 250) remains inactive such that heat is not actively generated or, alternatively, the heater may be directed to a relatively low heat setting (i.e., a first heat setting that is lower in power, voltage, duty cycle, or temperature than a second heat setting of the dry cycle). For instance, the compressor 254 may be directed to a reduced state. Optionally, compressor 254 may be held inactive to restrict the flow of refrigerant through sealed system 250. Nonetheless, air may be cycled through chamber 126 along the same path as air circulated during a dry cycle (e.g., as described above).

Although laundry appliance 100 is depicted and described herein as a heat pump dryer appliance, the inventive aspects of the present disclosure can apply to other types of closed loop airflow circuit dryer appliances. For instance, in other embodiments, laundry appliance 100 can utilizes an air-to-air heat exchanger instead of evaporator 252 or an electric or gas heating element may be provided instead of condenser 256. Thus, in such embodiments, the working fluid that interacts thermally with the process air may be air. Further, in some embodiments, laundry appliance 100 can be a combination washer/dryer appliance having a closed loop airflow circuit along which process air may flow for drying operations.

Now that the construction of laundry appliance 100 and the configuration of controller 166 according to exemplary embodiments have been presented, an exemplary method 400 of operating a laundry appliance will be described. Although the discussion below refers to the exemplary method 400 of operating laundry appliance 100, one skilled in the art will appreciate that the exemplary method 400 is applicable to the operation of a variety of other laundry appliances. In exemplary embodiments, the various method steps as disclosed herein may be performed by controller 166 (e.g., as a wash/dry operation) or a separate, dedicated controller.

Advantageously, embodiments described herein may automatically (e.g., without requiring direct user input) preserve articles within a given load to prevent the development of wrinkles, mildew, foul smells, etc. Additionally or alternatively, the described embodiments may notably permit a user to selectively adjust operation (e.g., a wash/dry operation) of a laundry appliance to ensure certain articles are properly treated or evaluated.

Figure 4:
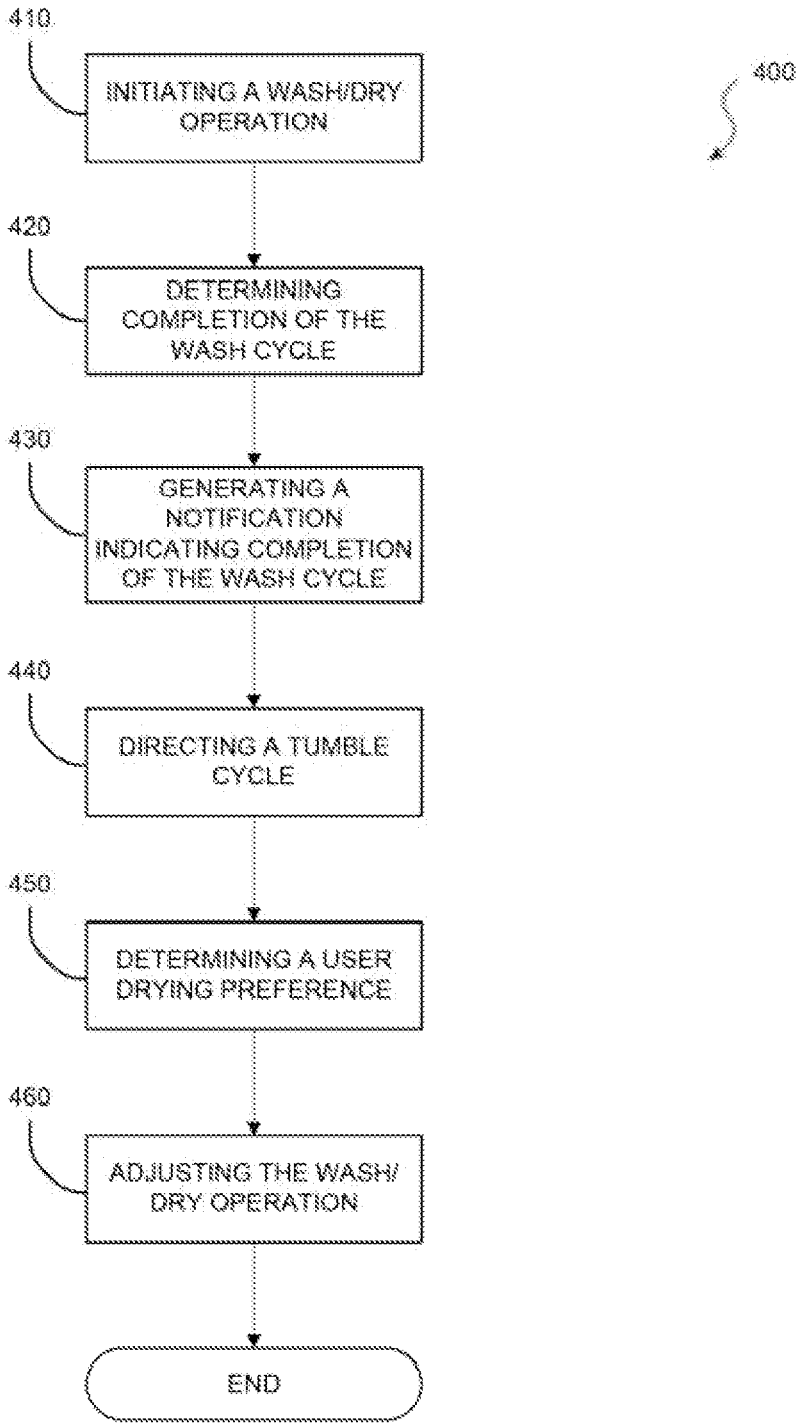
FIG. 4 illustrates a method for operating a laundry appliance in accordance with exemplary embodiments of the present disclosure.

Referring now to FIG. 4, at 410, the method 400 includes initiating a wash/dry operation for articles within the laundry basket. Generally, the wash/dry operation includes a discrete wash cycle and dry cycle. In other words, the wash/dry operation may include a first cycle in which the articles are wetted and washed (e.g., as described above) and a separate second cycle that follows the first cycle and in which the wetted/washed articles are actively heated or dried (e.g., as described above). Thus, 410 may prompt the wash cycle and cause it to be executed.

As would be understood, initiation of the wash/dry operation may be prompted by any suitable input from a user. For instance, a user may engage (e.g., press, turn, toggle, touch, etc.) the user interface of the laundry appliance to select the wash/dry operation (e.g., including attributes thereof) or otherwise register an intent for the wash/dry operation to begin. Additionally or alternatively, a user may engage (e.g., press, turn, toggle, touch, etc.) a consumer device from a remote location relative to the laundry appliance to select the wash/dry operation (or attributes thereof) or otherwise register an intent for the wash/dry operation to begin.

At 420, the method 400 includes determining completion of the wash cycle. Generally, determination that the wash cycle has ended may be made in any suitable manner. For instance, as would be understood, expiration of one or more timers or, additionally or alternatively, one or more received signals from one or more sensors may provide an indication that the articles are sufficiently washed. In turn, the laundry basket may be drained or subjected to a spin phase, as described above, to remove a majority of the wash fluid from the laundry basket.

At 430, the method 400 includes generating a notification indicating completion of the wash cycle in response to 420. For instance, a light may be activated or a message may be generated at the user interface of the laundry appliance to alert a user that the wash cycle has been completed. Additionally or alternatively, an audible alert may be generated from a speaker (e.g., included with the user interface of the laundry appliance). Further additionally or alternatively, a message or audible alert may be generated at the consumer device (e.g., to permit a user to be informed remotely of completion of the wash cycle). Such notifications are generally understood in the art and should not be considered as limited to any one of the listed examples.

At 440, the method 400 includes directing a tumble cycle of the laundry basket in response to 420. During 440, the heater (e.g., sealed system, electric heating element, gas heating element, etc.) may be maintained or held in a reduced or inactive state. Thus, the heater may be prevented from significantly or actively heating the air or articles within the laundry basket (i.e., in comparison to the dry cycle). In the case of a sealed system, the compressor may be prevented from rotating or otherwise motivating refrigerant through the sealed system. Although the heater may be maintained in the reduced or inactive state, air may be circulated through the laundry basket. For instance, the blower fan may be activated to draw air from the laundry basket and to the intake conduit. Optionally, such air may be returned to the laundry basket through, for example, the return conduit.

Separate from or in addition to maintaining the heater in the reduced or inactive state, the laundry basket may be rotated during 440. As an example, the laundry basket may spin (e.g., at a relatively slow rate in comparison to a spin cycle) repeatedly about the rotation axis as directed by the motor. In some such embodiments, the rate of rotation (e.g., rotations per minute) may be configured to permit articles to fall or otherwise remain unplastered to the cylindrical wall of the laundry basket. As another example, the laundry basket may be oscillated in opposite clockwise and counterclockwise directions about the rotation axis as directed by the motor.

Optionally, 440 may be started or initiated in tandem with 430. Alternatively, 440 and 430 may be performed separately. For instance, 440 may be performed subsequent to or, alternatively, prior to 430. Nonetheless, 440 may occur directly following 420. In turn, air or articles within the laundry basket may be prevented from remaining static within the laundry basket for any significant amount of time (e.g., greater than one minute, five minutes, or ten minutes).

At 450, the method 400 includes determining a user drying preference. Generally, 450 occurs during 440. In other words, 450 occurs while the tumble cycle is being performed (e.g., during rotation of the laundry basket) and, thus, following the start of 440 and prior to the end of the initiated tumble cycle.

In some embodiments, 450 may indicate a user's preference for how and when the dry cycle may start. As an example, a user may wish for a dry cycle to begin directly from the tumble cycle. To that end, 450 may include receiving a drying input signal from the user interface of the laundry appliance or consumer device. Such a drying input signal may indicate, for example, that a user has engaged or pressed an input corresponding to an immediate start of the dry cycle. Additionally or alternatively, a timer signal may indicate no user engagement has been detected prior to expiration of a predetermined tumble time (i.e., set maximum time of the tumble cycle) and that the dry cycle should start. The predetermined tumble time may be set as a time span greater than, for example, one minute, five minutes, or ten minutes.

As another example, a user may wish to temporarily stop the wash/dry operation (e.g., in order to remove one or more articles from the laundry basket). To that end, 450 may include receiving a pause input signal. For instance, the pause input signal may be received from the user interface of the laundry appliance, the consumer device, or the latch assembly. As a result, the pause input signal may indicate that a user has engaged or pressed an input corresponding to a pause of the wash/dry operation or, alternatively, that a user has opened the door to access the laundry basket. In turn, the pause input signal may be prompted (e.g., transmitted to the controller) in response to selecting a pause input or, alternatively, opening the door.

At 460, the method 400 includes adjusting the wash/dry operation. In particular, adjusting may be based on (e.g., and in response to) the determined user drying preference of 450. As an example, if the drying input signal has been received, 460 may include initiating the dry cycle activation of the heater to heat articles within the basket. Thus, the tumble cycle may be ended to allow for the dry cycle to be performed. During the dry cycle, the heater may be activated (e.g., as described above) or otherwise increased in power, voltage, duty cycle, or temperature to heat articles within the basket.

As another example, if the pause input signal has been received, 460 may include halting rotation of the laundry basket. The tumble cycle may further be halted (e.g., such that the blower fan is directed to an inactive state). While rotation is halted, a user may be able to remove one or more articles within the laundry basket (e.g., to air dry or evaluate one or more objects). Following halting rotation or the tumble cycle generally, 460 may further include receiving a resumption signal (e.g., from the user interface or consumer device) to indicate a user's desire to proceed with the wash/dry operation. Optionally, the dry cycle may be initiated in response to receiving the resumption signal. During the dry cycle, the heater may be activated (e.g., as described above) to heat articles within the basket.

Once initiated, the dry cycle may continue until completion (e.g., until expiration of one or more timers or, additionally or alternatively, one or more received signals from one or more sensors), as would be understood.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combination washer/dryer appliance comprising:

a cabinet;

a tub positioned within the cabinet, the tub defining a tub outlet and a tub inlet;

a laundry basket rotatably mounted within the tub, the laundry basket defining a chamber for receipt of articles for washing or drying;

a heater configured to heat and remove moisture from air flowing therethrough; and a controller operably coupled to the heater and configured to initiate a wash/dry operation, the wash/dry operation comprising:

initiating a wash/dry operation for articles within the laundry basket, the wash/dry operation comprising a wash cycle and a dry cycle, determining completion of the wash cycle, directing a tumble cycle of the laundry basket in response to determining completion of the wash cycle, wherein the tumble cycle comprises rotating the laundry basket, determining a user drying preference during the tumble cycle of the laundry basket, adjusting the wash/dry operation based on the determined user drying preference, and generating a notification indicating completion of the wash cycle in response to determining completion of the wash cycle prior to adjusting the wash/dry operation.

2. The combination washer/dryer appliance of claim 1, wherein determining the user drying preference comprises receiving a drying input signal from a user interface.

3. The combination washer/dryer appliance of claim 2, wherein adjusting the wash/dry operation comprises initiating the dry cycle activation to heat articles within the laundry basket.

4. The combination washer/dryer appliance of claim 1, wherein determining the user drying preference comprises receiving a pause input signal.

5. The combination washer/dryer appliance of claim 4, wherein the pause input signal is prompted in response to opening a door of the combination washer/dryer appliance.

6. The combination washer/dryer appliance of claim 4, wherein the pause input signal is prompted in response to user engagement of a corresponding portion of a user interface of the combination washer/dryer appliance.

7. The combination washer/dryer appliance of claim 4, wherein adjusting the wash/dry operation comprises halting rotation of the laundry basket.

8. The combination washer/dryer appliance of claim 7, wherein adjusting the wash/dry operation further comprises receiving a resumption signal following halting rotation of the laundry basket.

9. The combination washer/dryer appliance of claim 8, wherein adjusting the wash/dry operation further comprises initiating the dry cycle in response to receiving the resumption signal, wherein the dry cycle comprises activating of the heater to heat articles within the laundry basket.

10. A method of operating a combination washer/dryer appliance comprising a cabinet, a laundry basket rotatably mounted within the cabinet, and a heater in thermal communication with the laundry basket, the method comprising:

initiating a wash/dry operation for articles within the laundry basket, the wash/dry operation comprising a wash cycle and a dry cycle;

determining completion of the wash cycle;

directing a tumble cycle of the laundry basket in response to determining completion of the wash cycle, wherein the tumble cycle comprises rotating the laundry basket;

determining a user drying preference during the tumble cycle of the laundry basket;

adjusting the wash/dry operation based on the determined user drying preference; and generating a notification indicating completion of the wash cycle in response to determining completion of the wash cycle prior to adjusting the wash/dry operation.

11. The method of claim 10, wherein determining the user drying preference comprises receiving a drying input signal from a user interface.

12. The method of claim 11, wherein adjusting the wash/dry operation comprises initiating the dry cycle to heat articles within the laundry basket.

13. The method of claim 10, wherein determining the user drying preference comprises receiving a pause input signal.

14. The method of claim 13, wherein the pause input signal is prompted in response to opening a door of the combination washer/dryer appliance.

15. The method of claim 13, wherein the pause input signal is prompted in response to user engagement of a corresponding portion of a user interface of the combination washer/dryer appliance.

16. The method of claim 13, wherein adjusting the wash/dry operation comprises halting rotation of the laundry basket.

17. The method of claim 16, wherein adjusting the wash/dry operation further comprises receiving a resumption signal following halting rotation of the laundry basket.

18. The method of claim 17, wherein adjusting the wash/dry operation further comprises initiating the dry cycle in response to receiving the resumption signal, wherein the dry cycle comprises activating of the heater to heat articles within the laundry basket.

19. A combination washer/dryer appliance comprising:

a cabinet;

a tub positioned within the cabinet, the tub defining a tub outlet and a tub inlet;

a laundry basket rotatably mounted within the tub, the laundry basket defining a chamber for receipt of articles for washing or drying;

a heater configured to heat and remove moisture from air flowing therethrough; and a controller operably coupled to the heater and configured to initiate a wash/dry operation, the wash/dry operation comprising:

initiating a wash/dry operation for articles within the laundry basket, the wash/dry operation comprising a wash cycle and a dry cycle, determining completion of the wash cycle, directing a tumble cycle of the laundry basket in response to determining completion of the wash cycle, wherein the tumble cycle comprises rotating the laundry basket, determining a user drying preference during the tumble cycle of the laundry basket, wherein determining the user drying preference comprises receiving a pause input signal, and adjusting the wash/dry operation based on the determined user drying preference, wherein adjusting the wash/dry operation comprises halting rotation of the laundry basket.

20. The combination washer/dryer appliance of claim 19, wherein adjusting the wash/dry operation further comprises initiating the dry cycle in response to receiving the resumption signal, wherein the dry cycle comprises activating of the heater to heat articles within the laundry basket.

* * * * *